US007318768B2

(12) United States Patent
Deshpande et al.

(10) Patent No.: US 7,318,768 B2
(45) Date of Patent: Jan. 15, 2008

(54) LOW PROFILE ELECTRIC SANDER

(75) Inventors: Uday S. Deshpande, Baltimore, MD (US); Bhanuprasad V. Gorti, Abingdon, MD (US); Jason R. Melvin, Baltimore, MD (US); Gregory A. Rice, Aberdeen, MD (US); David Wikle, York, PA (US); Shailesh P. Waikar, Cockeysville, MD (US); William F. Hilsher, Parkville, MD (US)

(73) Assignee: Black & Decker Inc., Newark, DE (US)

( * ) Notice: Subject to any disclaimer, the term of this patent is extended or adjusted under 35 U.S.C. 154(b) by 47 days.

(21) Appl. No.: 11/103,928

(22) Filed: Apr. 12, 2005

(65) Prior Publication Data

US 2005/0245182 A1 Nov. 3, 2005

Related U.S. Application Data

(60) Provisional application No. 60/561,808, filed on Apr. 13, 2004.

(51) Int. Cl.
*B49B 49/00* (2006.01)
*B51B 51/00* (2006.01)
*B24B 23/04* (2006.01)

(52) U.S. Cl. ..... 451/5; 451/357; 451/359

(58) Field of Classification Search ..... 451/5, 451/8, 9, 344, 350, 351, 352, 353, 354, 355, 451/356, 357, 358, 359
See application file for complete search history.

(56) References Cited

U.S. PATENT DOCUMENTS 3,569,753 A 3/1971 Babikyan
3,585,427 A 6/1971 Paule (Continued)

FOREIGN PATENT DOCUMENTS

DE 1710412 10/1955

(Continued)

OTHER PUBLICATIONS

Sketch of Ridgid R2600 Sander (See Section III (c) of Supp. IDS), Aug. 10, 2001.

(Continued)

*Primary Examiner*—Timothy V. Eley
(74) *Attorney, Agent, or Firm*—Harness, Dickey & Pierce, P.L.C.

(57) ABSTRACT

A power tool is a "low profile" power tool, that is the overall height of the power tool is sufficiently small that a user can grasp the top of the power tool with the user's hand and the hand will be positioned relative close to the bottom of the power tool compared with existing power tools. The low profile power tool uses a low profile motor having a diameter to lamination height ratio of at least 2:1. In an aspect of the invention, the motor is an electronically commutated "pancake" style motor. In an aspect of the invention, the power tool is a random orbital sander or an orbital sander having a motor that provides at least 40 watts of power. In an aspect of the invention, the sander has a mechanical brake that brakes the orbital mechanism and the motor is dynamically braked.

56 Claims, 8 Drawing Sheets

U.S. PATENT DOCUMENTS

| | | | | | |
|---|---|---|---|---|---|
| 4,392,098 | A | | 7/1983 | Min | |
| 4,478,010 | A | | 10/1984 | Dicke | |
| 4,489,261 | A | | 12/1984 | Hartwig et al. | |
| 4,513,381 | A | | 4/1985 | Houser, Jr. et al. | |
| 4,542,551 | A | * | 9/1985 | Phillips | 15/49.1 |
| 4,556,828 | A | * | 12/1985 | Thompson | 318/254 |
| 4,565,938 | A | | 1/1986 | Fawzy | |
| 4,592,170 | A | * | 6/1986 | Hutchins et al. | 451/357 |
| 4,660,329 | A | * | 4/1987 | Hutchins | 451/357 |
| 4,671,019 | A | * | 6/1987 | Hutchins | 451/357 |
| 4,845,798 | A | * | 7/1989 | Genovese | 15/98 |
| 4,986,036 | A | * | 1/1991 | Hutchins | 451/344 |
| D317,244 | S | | 6/1991 | Bunyea | |
| 5,029,416 | A | | 7/1991 | Roberts et al. | |
| 5,033,238 | A | | 7/1991 | Zubler | |
| 5,063,319 | A | | 11/1991 | Mason et al. | |
| 5,253,990 | A | * | 10/1993 | Hutchins | 418/270 |
| 5,296,768 | A | | 3/1994 | Burger et al. | |
| 5,357,715 | A | | 10/1994 | Hiramatsu | |
| 5,365,155 | A | | 11/1994 | Zimmermann | |
| D353,984 | S | | 1/1995 | Izumisawa | |
| 5,392,568 | A | | 2/1995 | Howard, Jr. et al. | |
| 5,396,207 | A | | 3/1995 | Dorri et al. | |
| 5,419,737 | A | | 5/1995 | Brazell et al. | |
| 5,496,207 | A | | 3/1996 | Hornung et al. | |
| 5,580,302 | A | | 12/1996 | Howard, Jr. et al. | |
| 5,582,541 | A | * | 12/1996 | Hutchins | 451/357 |
| 5,594,306 | A | | 1/1997 | Caporusso et al. | |
| 5,595,531 | A | * | 1/1997 | Niemela et al. | 451/357 |
| 5,662,174 | A | | 9/1997 | Vermilyer | |
| 5,716,263 | A | | 2/1998 | Jones et al. | |
| 5,813,903 | A | * | 9/1998 | Amano et al. | 451/294 |
| 5,947,804 | A | * | 9/1999 | Fukinuki et al. | 451/357 |
| 5,947,806 | A | | 9/1999 | Rhoads | |
| 6,060,850 | A | | 5/2000 | Sakabe | |
| 6,084,366 | A | | 7/2000 | Koselke et al. | |
| 6,120,363 | A | | 9/2000 | Dunn | |
| 6,132,301 | A | | 10/2000 | Kaiser | |
| 6,236,177 | B1 | | 5/2001 | Zick et al. | |
| 6,257,970 | B1 | | 7/2001 | Huber | |
| 6,264,539 | B1 | | 7/2001 | Chen | |
| 6,316,895 | B1 | | 11/2001 | Ramarathnam | |
| 6,320,286 | B1 | | 11/2001 | Ramarathnam | |
| 6,394,884 | B1 | | 5/2002 | Wuensch | |
| 6,394,885 | B2 | | 5/2002 | Georgiou | |
| 6,506,107 | B2 | * | 1/2003 | Clowers et al. | 451/359 |
| 6,514,131 | B1 | * | 2/2003 | Reich et al. | 451/344 |
| 6,518,719 | B1 | | 2/2003 | Suzuki et al. | |
| 6,536,536 | B1 | | 3/2003 | Gass et al. | |
| 6,538,403 | B2 | | 3/2003 | Gorti et al. | |
| 6,592,441 | B2 | | 7/2003 | McCracken et al. | |
| 6,696,814 | B2 | | 2/2004 | Henderson et al. | |
| 6,703,724 | B1 | * | 3/2004 | Hobson et al. | 310/12 |
| D488,365 | S | | 4/2004 | Liu | |
| 6,758,731 | B2 | | 7/2004 | Dutter et al. | |
| 6,790,134 | B2 | | 9/2004 | Swaddle et al. | |
| 6,843,327 | B2 | | 1/2005 | Meixner et al. | |
| 6,900,606 | B2 | | 5/2005 | Youm | |
| D509,417 | S | | 9/2005 | Wikle et al. | |
| 6,943,510 | B2 | | 9/2005 | Gorti | |
| 6,956,751 | B2 | | 10/2005 | Youm et al. | |
| 6,979,976 | B2 | | 12/2005 | Tachibana | |
| 7,055,620 | B2 | | 6/2006 | Nadige et al. | |
| D527,595 | S | | 9/2006 | Wikle | |
| D527,965 | S | | 9/2006 | Aglassinger | |
| 2003/0032381 | A1 | | 2/2003 | Dutterer et al. | |
| 2003/0117095 | A1 | | 6/2003 | Gorti | |
| 2004/0082283 | A1 | | 4/2004 | Lindell et al. | |
| 2004/0155623 | A1 | | 8/2004 | Youm | |

FOREIGN PATENT DOCUMENTS

| | | |
|---|---|---|
| DE | 6935441 | 3/1971 |
| DE | 2202872 | 7/1973 |
| DE | P2211077 | 9/1973 |
| DE | 2358327 | 5/1975 |
| DE | 2355787 | 8/1975 |
| DE | P2830826 | 1/1980 |
| DE | 3733293 | 4/1989 |
| DE | 4240995 | 12/1992 |
| DE | 10023226 | 10/2001 |
| DE | 20311904 | 8/2003 |
| DE | 10239625 | 3/2004 |
| EP | 0491424 | 12/1990 |
| EP | 0320599 | 6/1991 |
| EP | 1285727 | 2/2003 |
| GB | 0588057 | 3/1994 |
| GB | 0987724 | 3/2000 |
| JP | 5790358 | 6/1982 |
| JP | 58148653 | 9/1983 |
| JP | 03190684 | 8/1991 |
| JP | 05104454 | 4/1993 |
| JP | 06189516 | 7/1994 |
| JP | 10112946 | 4/1998 |
| WO | WO-97/45944 | 12/1997 |
| WO | WO-0123137 | 4/2001 |

OTHER PUBLICATIONS

Pictures of DW421 Sander Motor (See Section III (c) of Supp. IDS), before Mar. 13, 2003.

Catalog pp. of DW423K Sander Motor (See Section III (c) of Supp. IDS), before Mar. 13, 2003.

* cited by examiner

LOW PROFILE ELECTRIC SANDER

CROSS-REFERENCE TO RELATED APPLICATIONS

This application claims the benefit of U.S. Provisional Application No. 60/561,808, filed on Apr. 13, 2004. The disclosure of the above application is incorporated herein by reference.

FIELD OF THE INVENTION

The present invention relates to power tools, and more particularly to random orbital sanders and orbital sanders.

BACKGROUND OF THE INVENTION

Orbital sanders, such as random orbital sanders, are used in a variety of applications where it is desirable to obtain an extremely smooth surface free of scratches and swirl marks. Such applications typically involve wood working applications such as furniture construction or vehicle body repair applications, just to name a few.

Random orbital sanders typically include a platen that is driven rotationally by a motor-driven spindle. The platen is driven via a freely rotatable bearing that is eccentrically mounted on the end of the drive spindle. Rotation of the drive spindle causes the platen to orbit about the drive spindle while frictional forces within the bearing, as well as varying frictional loads on the sanding disc attached to the platen, cause the platen to also rotate about the eccentric bearing, thereby imparting the "random" orbital movement to the platen. Typically such random orbit sanders also include a fan member which is driven by the output shaft of the motor. The fan member is adapted to draw dust and debris generated by the sanding action up through openings formed in the platen and into a filter or other like dust collecting receptacle.

One such prior art random orbital sander is disclosed in U.S. Pat. No. 5,392,568 for Random Orbit Sander Having Braking Member (the entire disclosure of which is incorporated herein by reference). For context, a short section of the '568 patent describing a random orbital sander is repeated here. With reference to FIG. 7, a random orbital sander 10 generally includes a housing 12 which includes a two-piece upper housing section 13 and a two-piece shroud 14 at a lower end thereof. Removably secured to the shroud 14 is a dust canister 16 for collecting dust and other particulate matter generated by the sander during use. A platen 18 having a piece of sandpaper 19 (FIG. 8) releasably adhered thereto is disposed beneath the shroud 14. The platen 18 is adapted to be driven rotationally and in a random orbital pattern by a motor disposed within the upper housing 13. The motor (shown in FIG. 8) is turned on and off by a suitable on/off switch 20 which can be controlled easily with a finger of one hand while grasping the upper end portion 22 of the sander. The upper end portion 22 further includes an opening 24 formed circumferentially opposite that of the switch 20 through which a power cord 26 extends.

The shroud 14 is preferably rotatably coupled to the upper housing section 13 so that the shroud 14, and hence the position of the dust canister 16, can be adjusted for the convenience of the operator. The shroud section 14 further includes a plurality of openings 28 (only one of which is visible in FIG. 7) for allowing a cooling fan driven by the motor within the sander to expel air drawn into and along the interior area of the housing 12 to help cool the motor.

With reference now to FIG. 8, the motor can be seen and is designated generally by reference numeral 30. The motor 30 includes an armature 32 having an output shaft 34 associated therewith. The output shaft or drive spindle 34 is coupled to a combined motor cooling and dust collection fan 36. In particular, fan 36 comprises a disc-shaped member having impeller blades formed on both its top and bottom surfaces. The impeller blades **36*a* formed on the top surface serve as the cooling fan for the motor, and the impeller blades 36*b* formed on the bottom surface serve as the dust collection fan for the dust collection system. Openings 18*a* formed in the platen 18 allow the fan 36*b* to draw sanding dust up through aligned openings 19*a* in the sandpaper 19 into the dust canister 16 to thus help keep the work surface clear of sanding dust. The platen 18 is secured to a bearing retainer 40 via a plurality of threaded screws 38 (only one of which is visible in FIG. 8) which extend through openings 18*b* in the platen 18. The bearing retainer 40 carries a bearing 42 that is journalled to an eccentric arbor 36*c* formed on the bottom of the fan member 36. The bearing assembly is secured to the arbor 36*c* via a threaded screw 44 and a washer 46. It will be noted that the bearing 42 is disposed eccentrically to the output shaft 34 of the motor, which thus imparts an orbital motion to the platen 18 as the platen 18 is driven rotationally by the motor 30**.

With further reference to FIG. 8, a braking member 48 is disposed between a lower surface 50 of the shroud 14 and an upper surface 52 of the platen 18. The braking member 48 comprises an annular ring-like sealing member which effectively seals the small axial distance between the lower surface 50 of the shroud 14 and the upper surface 52 of the platen 18, which typically is on the order of 3 mm .+−.0.7 mm.

With reference to FIG. 9, the braking member 48 includes a base portion 54 having a generally planar upper surface 56, a groove 58 formed about the outer circumference of the base portion 54, a flexible, outwardly flaring wall portion 60 having a cross sectional thickness of preferably about 0.15 mm, and an enlarged outermost edge portion 62. The groove 58 engages an edge portion 64 of an inwardly extending lip portion 66 of the shroud 14 which secures the braking member 48 to the lip portion 66. In FIGS. 8 and 9, the outermost edge portion 62 is illustrated as riding on an optional metallic, and preferably stainless steel, annular ring 61 which is secured to the backside 52 of the platen 18. Alternatively, the entire backside of the platen 18 may be covered with a metallic or stainless steel sheet. While optional, the stainless steel annular ring or sheet 61 serves to substantially eliminate the wear that might be experienced on the upper surface 52 of the platen 18 if the outermost edge portion 62 were to ride directly thereon.

With brief reference to FIG. 10, the braking member 48 further includes a pair of radially opposed tabs 68 which engage notched recesses 70 in the inwardly extending lip portion 66 of the shroud 14. This prevents the braking member 48 from rotating with the platen 18 relative to the shroud 14 during operation of the sander 10. The braking member 48 is formed by injection molding as a single component from a material which allows a degree of flexure of the wall portion 60, and preferably from polyester butylene terephthalate (hereinafter "PBT").

The operation of the braking member 48 during use of the sander 10 will now be described. As the platen 18 is driven rotationally by the output shaft 34 of the motor 30, the outermost edge portion 62 of the braking member 48 rides frictionally over the upper surface 52 of the platen 18. The outermost edge portion 62 of the braking member 48 exerts a relatively constant, small downward spring force onto the stainless steel ring 61. The spring force is such that the random orbital action of the platen 18 is substantially unaffected under normal loading conditions, but the rotational speed of the platen 18 is limited when the platen 18 is lifted off of the work surface to about 1200 rpm. It has been determined that an operating speed of at least about 800 rpm is desirable to prevent the formation of swirl marks on the surface of the workpiece when the platen is loaded. Thus, 800 rpm represents a preferred lower speed limit which the braking member 48 must allow the platen 18 to attain when engaged with a work surface during normal operation to achieve satisfactory sanding performance. It has further been determined that if the platen is permitted when unloaded to attain rotational speeds substantially above normal operating speeds-e.g., above approximately 1200 rpm—the rapid deceleration that results when the platen is reapplied to the workpiece causes the sander 10 to jump which can produce undesirable gouges or scratches in a work surface. Thus, it is desirable for the braking member 48 to prevent the rotational speed of the platen 18 about bearing 42 to exceed approximately 1200 rpm when the platen 18 is unloaded, and permit the platen 18 to rotate above approximately 800 rpm when loaded.

To achieve the desired braking action the braking member 48 exerts a relatively constant preferred braking force of about 3.5 lbs. onto the stainless steel ring 61 at all times during operation of the sander 10. This degree of braking force is significantly less than the frictional torque imposed by the interface of the sandpaper 19 secured to the platen 18 and the workpiece, but of the same order of magnitude as the torque applied by the bearing 42. Consequently, the brake member 48 has an insignificant effect on the normal operation of the platen when under load, and a speed limiting effect on the platen when unloaded.

The desired braking force of about 3.5 lbs. is achieved by the combination of the geometry of the braking member 48 as well as the material used in its formation. It has been found that the use of PBT doped with about 2% silicon and about 15% Teflon provides a preferred flex modulus of about 46.5 kpsi. However, a material which provides a flex modulus anywhere within about 35 kpsi to 75 kpsi should be suitable to provide the desired degree of flexure to the brake member 48. The amount of braking force generated by the braking member 48 is important because a constant braking force in excess of about 4 lbs. causes excessive wear at the outermost edge portion 62, while a braking force of less than about 3 lbs. is too small to appropriately limit the increase in rotational speed of the platen 18 when the platen 18 is lifted off of a work surface.

One disadvantage the electrically powered random orbital sanders have compared to pneumatic sanders is due to the height of the sander. Heretofore, electrically powered random orbital sanders and orbital sanders have used mechanically commutated motors, such as universal series motors in the case of corded sanders, which dictates that the overall height of the electrically powered sander is greater than a comparable pneumatic sander. In electrically powered random orbital sanders, if the user grasps the sander by placing the palm of the user's hand over the top of the sander, the user's hand is sufficiently far from the work that the user is sanding to cause more fatigue than is the case with pneumatic sanders where the user can grasp the sander close to the work piece. This often leads to user's grasping electrically powered random orbital sanders on the side of the sander. This tends to be awkward compared to grasping the top of the housing. Also, the greater height of the electrically powered random orbital sander causes more wobble compared to the lower height pneumatic random orbital sander. The electrically powered sander is heavier than a comparable pneumatic sander due to the weight of the motor, further contributing to the wobble problem. The user of the electrically powered random orbital sander thus must grasp it more tightly than the lower height and weight pneumatic random orbital sander, causing additional fatigue in the user's hand.

SUMMARY OF THE INVENTION

A power tool in accordance with an embodiment of the invention is a "low profile" power tool. That is, the overall height of the power tool is sufficiently small that a user can grasp the top of the power tool with the user's hand and the hand will be positioned relative close to the bottom of the power tool compared with existing power tools. The low profile power tool uses a low profile motor having a diameter to lamination height ratio of at least 2:1. In an aspect of the invention, the motor is an electronically commutated "pancake" style motor.

In an aspect of the invention, the power tool is a random orbital sander or an orbital sander having a motor that provides at least 40 watts of power.

In an aspect of the invention, the sander has a mechanical brake that brakes the orbit mechanism and the motor is dynamically braked.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application, or uses.

Figure 1:
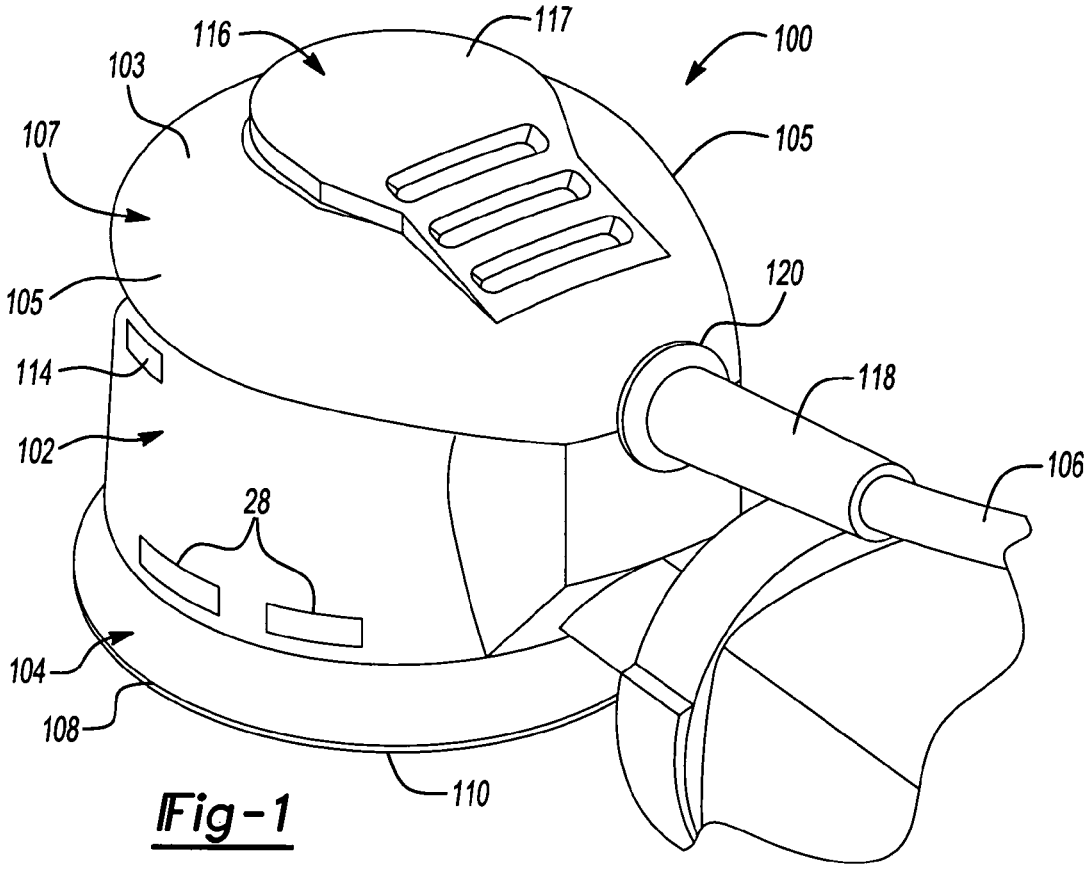
FIG. 1 is a perspective view of an electrically powered random orbital sander in accordance with an embodiment of the invention.
Figure 2:
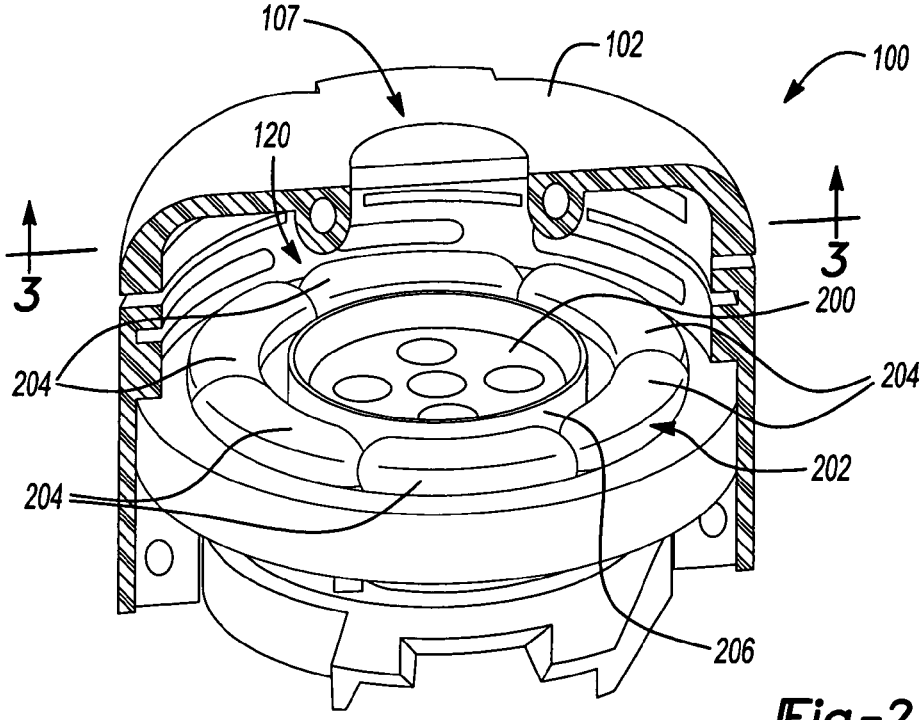
FIG. 2 is a perspective view, partially broken away, of the sander of FIG. 1.
Figure 3:
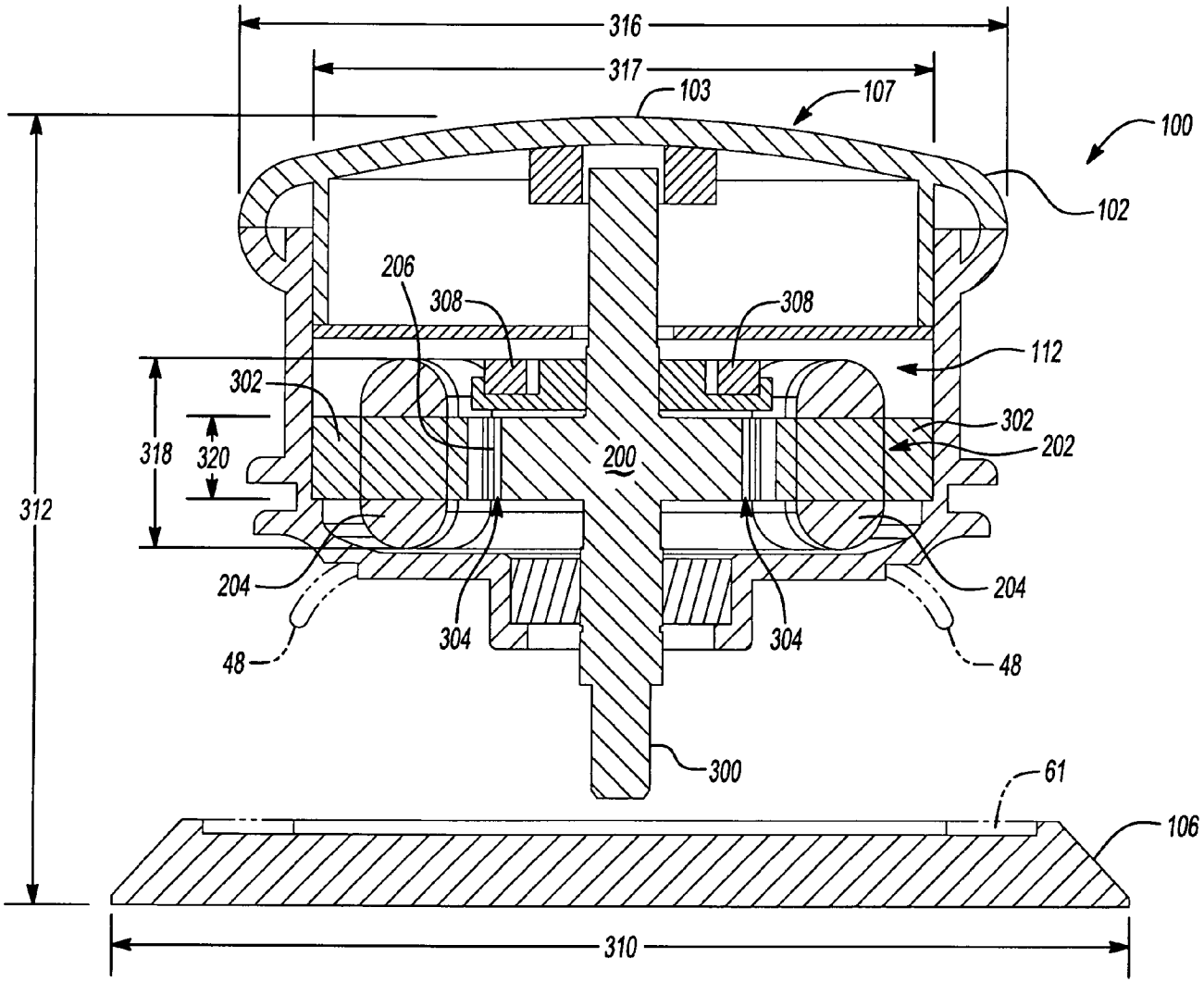
FIG. 3 is a cross-section view of the sander of FIG. 2 taken along the line 3-3.

Referring to FIGS. 1-3, a low profile power tool 100 is shown. Low profile power tool 100 will be described in the context of a random orbital sander and will be referred to as sander 100, but it should be understood that it can be other types of power tools where holding the power tool near where it contacts the work piece would be advantageous, such as orbital sanders (which are sometimes known as "quarter sheet" sanders").

Sander 100 includes a housing 102 and an orbit mechanism 104 disposed beneath housing 102. A dust canister 106 may illustratively be removably secured to housing 102. Orbit mechanism 104 and dust canister 106 may illustratively be conventional orbit mechanisms and dust canisters that have been used on prior art orbital sanders, such as disclosed in the above referenced U.S. Pat. No. 5,392,568 (the entirety of which is incorporated herein by reference). Orbit mechanism 104 includes a pad or platen 108 to which a piece of sandpaper 110 can be releasably adhered.

Figure 4:
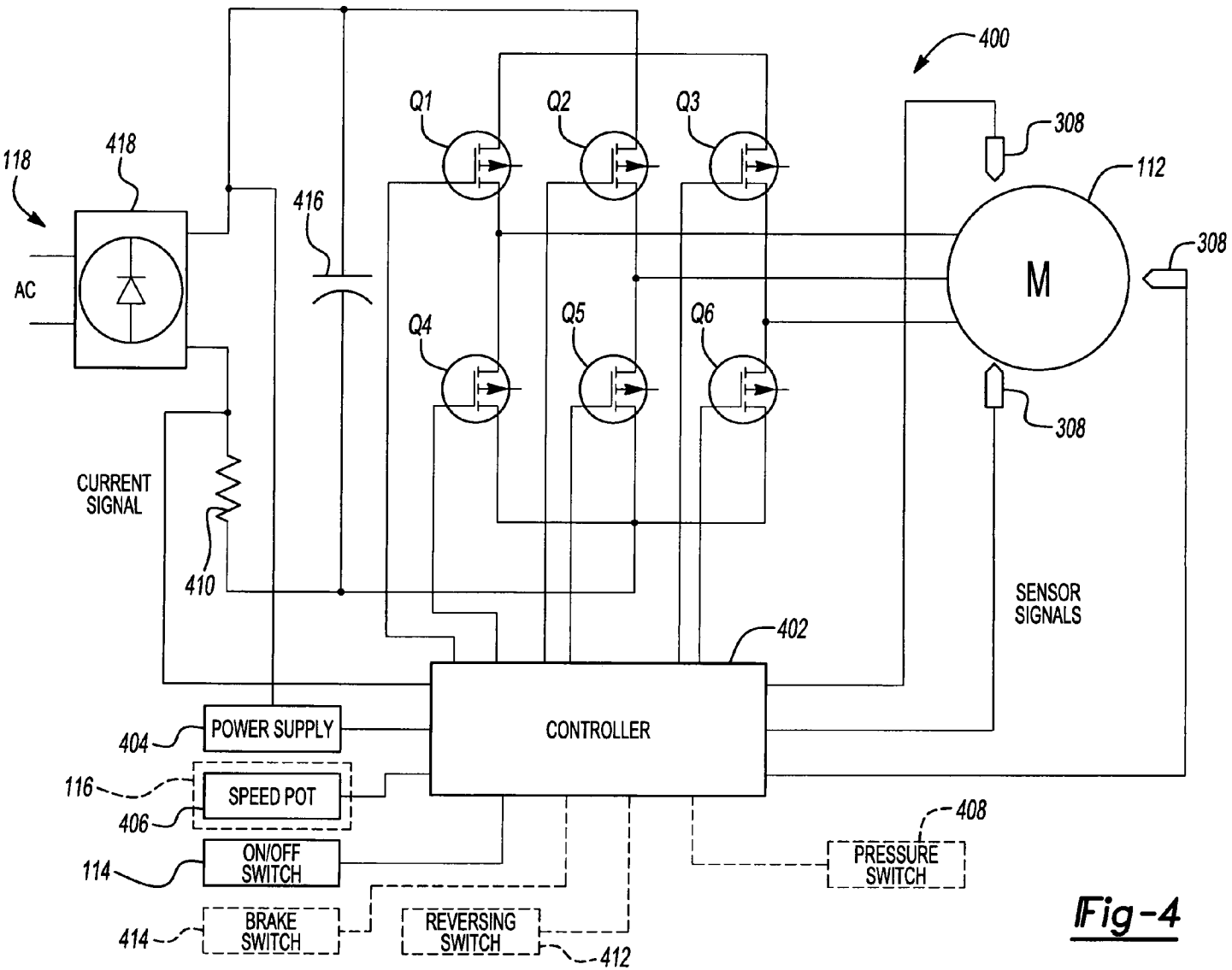
FIG. 4 is a schematic of a control system for an electronically commutated motor of the sander of FIGS. 1-3.

Orbit mechanism 104 is adapted to be driven rotationally and in a random orbital pattern by a motor 112 disposed within housing 102. Motor 112 is turned on and off by a suitable on/off switch 114. Variable speed of motor 112 may illustratively be provided by a trigger switch 116, illustratively having a speed potentiometer 406 (FIG. 4). Trigger switch 116 may illustratively be a paddle switch illustratively having a paddle type actuator member 117 shaped generally to conform to a palm of a user's hand. Trigger switch 116 may be referred to herein as paddle switch 116. It should be understood, however, that paddle switch 116 could also include on/off switch 114. In the embodiments shown in FIGS. 1-3, sander 100 is illustratively a corded sander, that is, powered by being connected to AC mains, and a power cord 118 extends out through a hole 120 in housing 102.

A top 103 of housing 102 is shaped to provide an ergonomic palm grip 107 for the user to grasp. Top 103 is shaped to have an arcuate cross-section that generally conforms with a palm of a user's hand, with edges 105 curving back to housing 102, which necks down beneath edges 105. A user can thus grip sander 100 by holding the top 103 of sander 100 in the palm of the user's hand and grasping edges 105 with the user's fingers which can extend under edges 105. While palm grip 107 of sander 100 is shown in FIGS. 1-3 as being generally round (when viewed from the top), it should be understood that palm grip 107 can have other shapes, such as oval, teardrop, elliptical, or the like. Palm grip 107 allows the user to keep the user's hand more open when grasping sander 100. The low profile of sander 100, discussed below, cooperates with palm grip 107 to allow the user to grasp the sander 100 more lightly compared to prior art corded random orbital and orbital sanders and thus helps prevent the user's fingers from cramping. Also, the height of housing 102 is sufficient to allow the user to grasp sander 100 from the side if so desired.

In an embodiment, sander 100 may include a mechanical braking member, such as brake member 48 and corresponding ring 61 (shown in phantom in FIG. 3) of the type described in U.S. Pat. No. 5,392,568.

Motor 112 is preferably an electronically commutated motor having a rotor 200 (FIG. 2) with an output shaft 300 (FIG. 3) associated therewith to which orbit mechanism 104 is coupled in conventional fashion, such as disclosed in U.S. Pat. No. 5,392,568. Motor 112 may be an electronically commutated motor of the type known as brushless DC motors (which is somewhat of a misnomer as the electronic commutation generates AC waveforms, when viewed over a full turn of the motor, that excite the motor). Motor 112 may also be an electronically commutated motor of the type known as AC synchronous motors which are excited with sinusoidal waveforms.

As is known, motor power for an electronically commutated motor, for a given electrical and magnetic load, is determined by $D^2L$ where D is the diameter of the motor and L is the height of the laminations of the stator. Motor 112 also has a stator 202 having a plurality of windings 204 wound about lamination stack or stacks 302. (Lamination stack(s) 302 are formed in conventional fashion and may be a single stack or a plurality of stacks.) Rotor 200 includes a plurality of magnets 304 disposed around its periphery 206. Position sensors 308 are mounted in housing 102 about rotor 200. Position sensors 308 may illustratively be Hall Effect sensors with three position sensors spaced 120 degrees about rotor 200.

Motor 112 is a low profile or "pancake" style motor. That is, the diameter of motor 112 is large compared to the height of lamination stacks 302. The height of windings 204 are also kept low keeping the overall height or length of motor 112 low. As used herein, a motor is considered "low profile" if it has a diameter to lamination stack height ratio of at least 2:1 and the diameter of the motor is greater than the height or length of the motor. In an embodiment, motor 112 has a diameter to lamination height ratio of greater than five. Also, by using an electronically commutated motor as motor 112, the weight of motor 112 is significantly less for a given power compared to mechanically commutated motors, such as universal series motors. The rotor 200 of electronically commutated motor 112 having a rated power output of 200 watts has a weight of about 30 grams. The armature of a universal series motor having a rated power output of 120 watts has a weight of about 190 grams. Assuming a weight of approximately 50 grams for the electronics that controls the electronically commutated motor, the electronically commutated motor still weighs significantly less than a universal motor having comparable power. Additionally, electronically commutated motors are quieter than universal series motors due to the elimination of the mechanical commutator. However it should be understood that motor 112 is not limited to electronically commutated motors and can be any motor that can be constructed with a low profile. In addition to electronically commutated motors, switched reluctance motors, induction motors, brush DC motors, axial permanent magnet motors (brush and brushless), and flux switching motors could be used for motor 112. Motor 112 may illustratively have a rated power output of at least 40 watts.

As mentioned, the sander 100 may preferably be a random orbital sander or orbital sander. Random orbital sanders and orbital sanders are typically used to sand larger surfaces, with smaller sanders known as "detail" sanders which are used to sand smaller surfaces. As such, platen 108 when used in a random orbital sander would typically have a diameter of five or six inches. (Random orbital sanders having a five inch diameter platen and random orbital sanders having a six in diameter platen are the most commonly sold random orbital sanders.) Orbital sanders typically have a rectangular platen, with typical widths of five or six inches. Motor 112 may illustratively have at least 70 watts of power with a diameter to lamination height ratio of at least 2:1 for a sander having a five inch platen, and preferably at least 120 watts of power and a diameter to lamination height ratio of at least 3:1. Motor 112 may illustratively have at least 100 watts of power with a diameter to lamination height ratio of at least 2:1 for a sander having a six inch platen, and may illustratively have at least 120 watts of power and a diameter to lamination height ratio of at least 3:1. In an embodiment, motor 112 may illustratively have at least 200 watts of power with a diameter to lamination height ratio of at least 3:1.

Using a low profile motor, such as motor 112 described above, in sander 100 allows sander 100 to have a "low profile." As used herein, a corded sander is "low profile" if it has a diameter of palm grip 107 to sander 100 height ratio of at least 0.4:1, and preferably at least 0.6:1 or greater, such as 1:1, where the maximum height of sander 100 does not exceed 120 mm for a corded sander.

With reference to FIG. 3, the diameter 310 of platen 108 of the illustrative low profile random orbital corded sander 100 is six inches (152.4 mm), the height 312 of sander 100 is 95 mm and the outside diameter 316 of top 103 of sander 100 (and thus of palm grip 107) is 90 mm. Magnets 304 are illustratively high powered rare earth magnets. The motor 112 has a rated power output of up to 200 watts with a diameter 317 of 75 mm and stack height (height of lamination stack 302) of 10 mm, giving motor 112 a diameter to lamination height ratio of 7.5:1. Motor 112 has an overall height 318 of 23 mm (illustratively determined by the height of windings 204). The diameter of palm grip 107 may illustratively range from 30 to 90 mm, and more preferably, from 70 to 90 mm, with the height of sander 100 not exceeding 120 mm as mentioned above. In an embodiment, the height of sander 100 is a maximum of 90 mm, the diameter of palm grip 107 is a maximum of 90 mm, and motor 112 has a rated power output of at least 120 watts. In a variation, the height of sander 100 is a maximum of 100 mm.

It should be understood that magnets 304 may illustratively be ferrite magnets or low powered bonded Neodymium magnets, in which event, motor 112 would have a lower rated power. Using ferrite magnets for magnets 304 would result in a decrease in rated power for motor 112, having the same dimensions, of about 50% and using low powered bonded Neodymium magnets for magnets 304 would result in a decrease in rated power for motor 112 of about 25%.

In an embodiment, motor 112 would have an illustrative rated power of at least 70 watts and a diameter to stack height ratio of 2:1. In another embodiment, motor 112 would have an illustrative rated power of at least 150 watts and a diameter to stack height ratio of 5:1.

Figure 6:
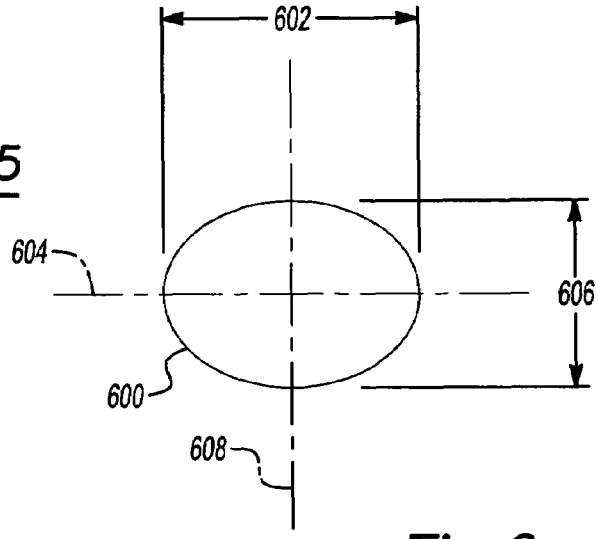
FIG. 6 is a representative view of an oval shaped palm grip that is an alternative to the round palm grip of the sander of FIGS. 1-3.
Figure 7:
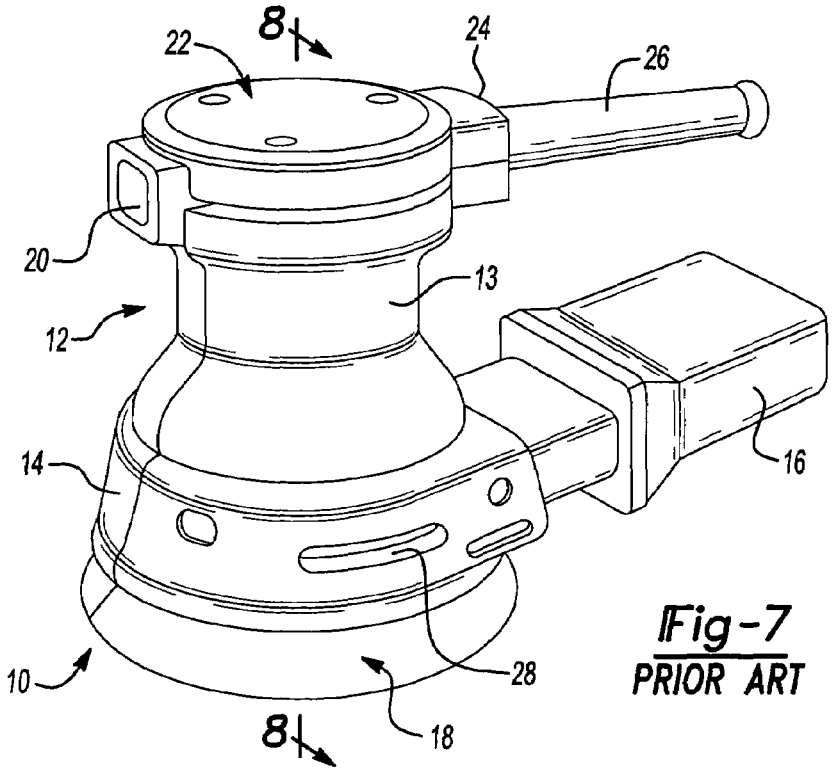
Fig-7 PRIOR ART
FIG. 7 is a perspective view of a prior art random orbital sander.

As mentioned, palm grip 107 can have shapes other than round shapes. In such cases, the diameter of the palm grip for the purposes of the palm grip diameter to sander height ratio is the minor diameter of the palm grip. For example, if palm grip 107 is oval shaped, shown representatively by oval 600 (FIG. 6), oval 600 has a major diameter 602 taken along a major axis 604 of oval 600 and a minor diameter 606 taken along a minor axis 608 of oval 600. Minor diameter 606 is thus the diameter of palm grip 107 for the purposes of the above discussed palm grip diameter to sander height ratio.

Figure 8:
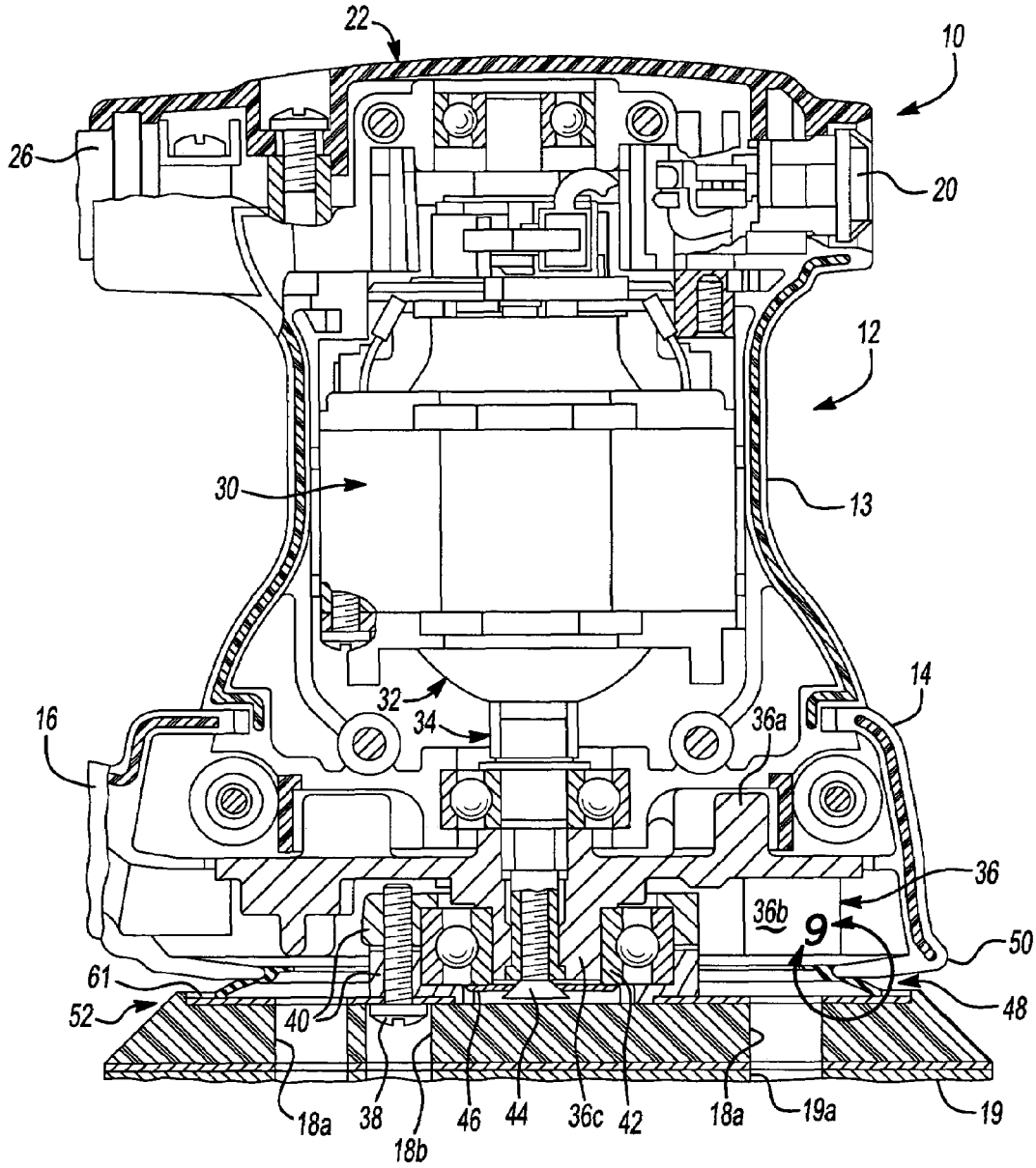
Fig-8 PRIOR ART
FIG. 8 is a cross-sectional view of the sander of FIG. 7 taken along the line 8-8.
Figure 9:
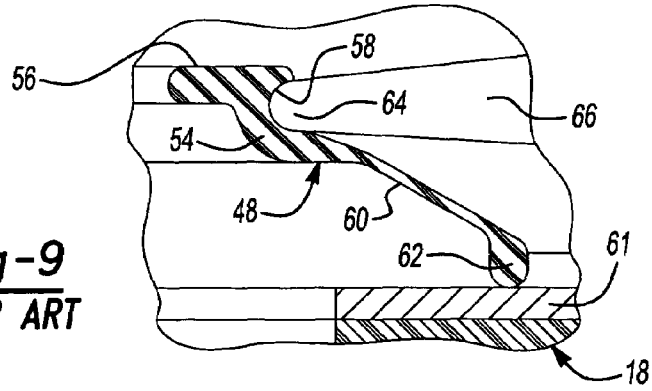
Fig-9 PRIOR ART
FIG. 9 is an enlarged fragmentary view of a portion of the braking member, shroud and pattern in accordance with the circled area 3 in FIG. 8.
Figure 10:
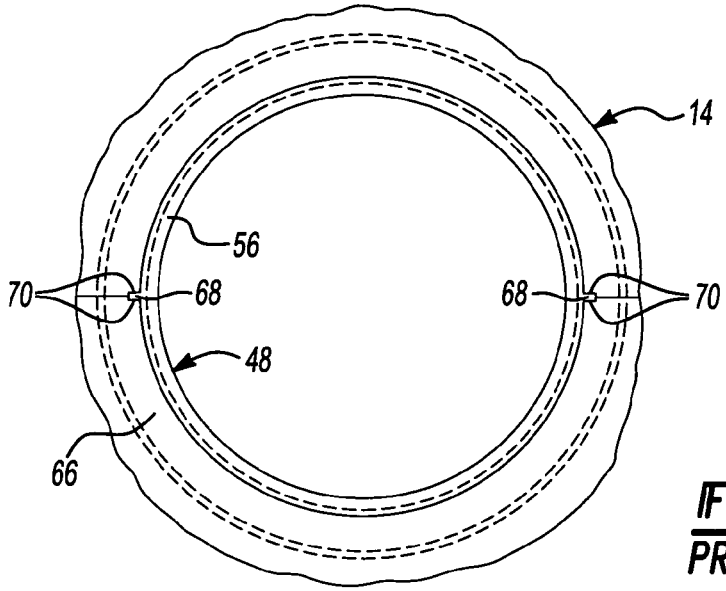
Fig-10 PRIOR ART
FIG. 10 is a plan view of the braking member showing how it is secured to the shroud of the housing of the sander, in accordance with section line 4-4 in FIG. 8.

The low profile aspect of sander 100 as mentioned reduces wobble compared to prior art corded sanders. Since weight is often added to the fan used in random orbital sanders and orbital sanders, such as fan 36 (FIG. 8), to counteract wobble, the weight of the fan can be reduced. For example, the weight of fan 36 in the prior art random orbital sander 10 having a five or six inch diameter platen 108 would illustratively be in the range of 100-200 grams. This weight could be reduced to about 70-120 grams in low profile sander 100. However, the weight of low profile sander 100 would illustratively be kept high enough to prevent "bouncing" when low profile sander 100 is applied to the workpiece. Illustratively, the weight of sander 100 would be in the 800 grams to 1400 grams range where sander 100 has a five or six inch diameter platen 108. This is comparable to the weight of prior art random orbital and orbital sanders as it is desirable that sander 100 have sufficient weight that that the sander 100 itself applies the needed pressure to urge the sander against the workpiece when sanding as opposed to the user applying pressure to sander 100. The user then need only guide the sander 100 on the workpiece, or need only apply light pressure to the sander 100. But by being able to reduce the weight of the fan in sander 100, the weight eliminated from the fan can be more optimally distributed in sander 100, or all or a portion of it eliminated from sander 100. Also, even if the weight of the fan is kept the same, the weight can be distributed in the fan to optimize performance aspects of sander 100 other than to counteract wobble, or at least to the degree needed in prior art sanders.

As mentioned, motor 112 may illustratively be an electronically commutated motor that is electronically commutated in conventional fashion using known electronically commutated motor control systems. These control systems can be adapted to provide additional functionality, as discussed with reference to FIG. 4.

FIG. 4 shows an electronic motor commutation control system 400 for controlling motor 112. Control system 400 includes switching semi-conductors Q1-Q6 having their control inputs coupled to outputs of an electronic motor commutation controller (also known as a brushless DC motor controller) 402. Control system 400 includes a power supply 404 coupled to power cord 118 that provides DC power to controller 402 via rectifier 418. A filter or smoothing capacitor 416 smoothes the output of rectifier 418. Switch 114 is coupled to an input of controller 402 as is speed potentiometer 406 of paddle switch 116. As mentioned above, switch 114 and paddle switch 116 may be separate switch devices or included in the same switch device.

A matrix consisting of motor speed and/or current information is used by controller 402 to determine the PWM duty cycle at which it switches Q1-Q6, which in turn controls the speed of motor 112. The setting of speed potentiometer 406, which may illustratively be determined by how far actuator member 117 of paddle switch 116 is depressed, dictates the speed at which controller 402 regulates motor 112 during operation of sander 100. Switch 114 may illustratively have an on/off control-level signal, such as may illustratively be provided by a micro-switch, which can be interfaced directly to controller 402. Also, a non-contact type of switch can be used, such as logic switch/transistor/FET, optical switch, or a Hall Effect sensor—magnet combination. It should be understood that switch 114 could be a mains switch that switches power on and off to sander 100, or at least to semiconductors Q1-Q6.

Illustratively, three position sensors 308 are used to provide position information of rotor 200 to controller 402 which controller 402 uses to determine the electronic commutation of motor 112. It should be understood, however, that two or one positions sensors 308 could be used, or a sensor-less control scheme used. Speed information may illustratively be obtained from these position signals in conventional fashion.

Sander 100 may illustratively include a sensor, such as a pressure sensor 408, that senses when sander 100 is removed from the work piece, such as by sensing a decrease in pressure on platen 108. A force sensor such as a strain gauge type of force sensor may alternatively or additionally be used. Based on the signal from pressure sensor 408 crossing a threshold value, controller 402 transitions from an "idle speed" mode where it regulates the speed of motor 112 at an idle speed to a "sanding speed" mode where it regulates the speed of motor 112 based on the position of speed potentiometer 406, and vice-versa. Thus, when sander 100 is applied to the work piece, controller 402 will transition to the "sanding speed" mode and when sander 100 is removed from the work piece, controller 402 will transition to the "idle speed" mode.

Alternatively, speed information determined from one or more of position sensors 308 and/or motor current determined from a current sensor 410 can be used by controller 402 to determine when to transition between the "idle speed" mode and the "sanding speed" mode. In an open loop control, the speed of the motor drops with load and the motor current increases with load for a given PWM duty cycle. Applying the sander to the work piece as it is running increases the load on the motor and decreases the motor speed. By determining the motor 112 speed and/or current at the idle speed PWM duty cycle, it can be determined whether sander 100 is being loaded or not. Based on the deviations of the motor 112 speed and/or current from a range of typical values when the motor 112 is running unloaded at idle speed, controller 402 can determine that sander 100 has been applied to the work piece and thus transition from the "idle speed" mode to the "sanding speed" mode. Similarly, based on the deviations of the motor 112 speed and/or current from a range of typical values when the motor 112 is running loaded, controller 402 can determine that sander 100 has been lifted from the work piece and thus transition from the "sanding speed" mode to the "idle speed" mode.

The current value threshold may illustratively be a single threshold value, with or without hysteresis. The motor speed threshold value may illustratively be two threshold values (with or without hysteresis), an "idle speed" threshold value for transitioning from the "idle speed" mode and a "sanding speed" threshold value for transitioning from the "sanding speed" mode. The motor idle speed is generally a low speed. The idle speed threshold value would be lower than the idle speed of the motor. For example, if the motor idle speed is 800 rpm then the idle speed threshold value may illustratively be 600 rpm. When the motor 112 speed drops below 600 rpm, the controller would transition to the "sanding speed" mode and ramp the speed of motor 112 to a "sanding" operating speed. For example, when sander 100 is applied to the work piece, for a given speed setting, the "sanding" operating speed of motor 112 may illustratively be in the range of 5,000 to 12,000 rpm. When sander 100 is removed from the work piece, the speed of motor 112 would increase. Thus, the "sanding speed" threshold value may illustratively be 200 rpm greater than the sanding speed. When the motor 112 speed exceeds the "sanding speed" threshold value, the controller 402 transitions to "idle speed" mode and reduces the speed of motor 112 to the idle speed.

A similar approach can be used with closed loop control. However, the closed loop speed control would be enabled only after the speed of motor 112 accelerates well beyond the idle speed, such as 200 rpm above the idle speed. When the sander 100 is operating at sanding speeds, i.e., applied to the work piece, and the load then removed, i.e., the sander 100 removed from the work piece, the speed of motor 112 then needs to be reduced to idle speed. This could occur immediately or after a predetermined time delay. In any event, controller 402 would determine whether to transition to the "idle speed" mode in the same manner as discussed above. Upon transitioning to the "idle speed" mode, the closed loop speed control would be disabled.

Figure 5:
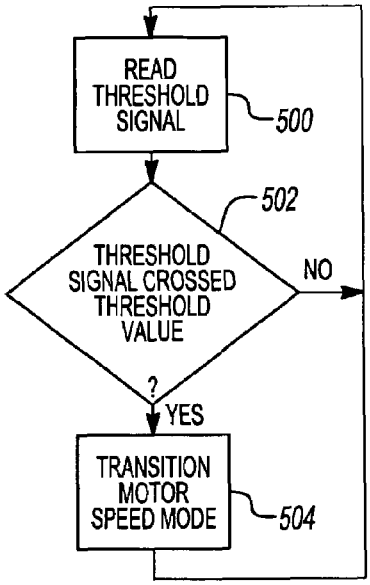
FIG. 5 is a flow chart of showing the steps by which the control system of FIG. 4 transitions between an "idle speed" mode and a "sanding speed" mode.

FIG. 5 is a flow chart showing a method by which controller 402 determines when to transition between the "idle speed" mode and the "sanding speed" mode. One or more of the pressure signal provided by pressure sensor 408, the speed signal determined from the signal(s) provided by one or more of position sensors 308 and the current signal provided by current sensor 410 are used by controller 402 to determine whether sander 100 has been applied to the work piece or removed from it, and will be referred to as the "threshold signal." At step 500, controller 402 reads the threshold signal. At step 502, controller 402 determines whether the threshold signal crossed the threshold value. If so, at step 504 controller 402 transitions between the "idle speed" mode and the "sanding speed" mode. The controller 402 transitions to the "sanding speed" mode from the "idle speed" mode if the threshold signal crossed the threshold value in a direction indicating that the sander 100 had been applied to the work piece. For example, if pressure sensor 408 is used and its signal increases above the pressure threshold value, the controller 402 determines that the sander 100 was applied to the work piece and transitions to the "sanding speed" mode. If a motor speed/current sensor combination is used and the motor speed (determined from one or more position sensors 308) decreases below the idle speed threshold value and the current sensor 410 signal increases above the current threshold value, the controller 402 determines that the sander 100 was applied to the work piece and transitions to the "sanding speed" mode. It should be understood that motor speed or current sensor 410 signal alone could be used in making this determination. Controller 402 transitions to the "idle speed" mode from the "sanding speed" mode when the converse occurs, indicating that the sander 100 has been removed from the work piece.

Figure 12:
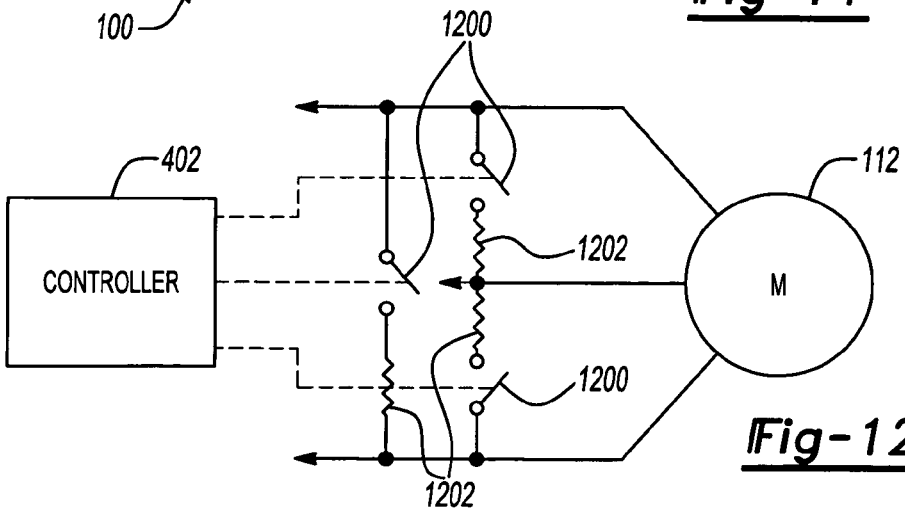
FIG. 12 is a simplified circuit schematic of dynamic braking including coupling resistors across motor windings.

Controller 402 may illustratively be powered-up all the time when it is plugged in. If so, controller 402 can be configured, such as by programming, to provide electronic braking, that is, to reverse commutate motor 112 to dynamically brake it. For example, when switch 114 is released, controller 402 switches semi-conductors Q1-Q6 to provide reverse commutation of motor 112 to brake it. In an illustrative embodiment, controller 402 switches semi-conductors Q4-Q6 to short the windings of motor 112 together to drain the energy in motor 112 to brake motor 112. In a variation with reference to FIG. 12, dynamic braking of motor 112 includes switching a resistor(s) 1202 across windings of motor 112, such as with switches 1200.

As used herein and as commonly understood, "dynamic braking" means braking an electric motor by quickly dissipating the back emf of the motor, such as by way of example and not of limitation, shorting winding(s) of the motor or coupling resistor(s) across windings of the motor.

Controller 402 may illustratively be configured to sense the collapse of an input voltage when on/off switch 114 is turned off to initiate braking. Alternatively, a separate brake switch 414 (shown in phantom in FIG. 4) may be provided that is actuated when on/off switch 114 is turned off to initiate braking.

Figure 15:
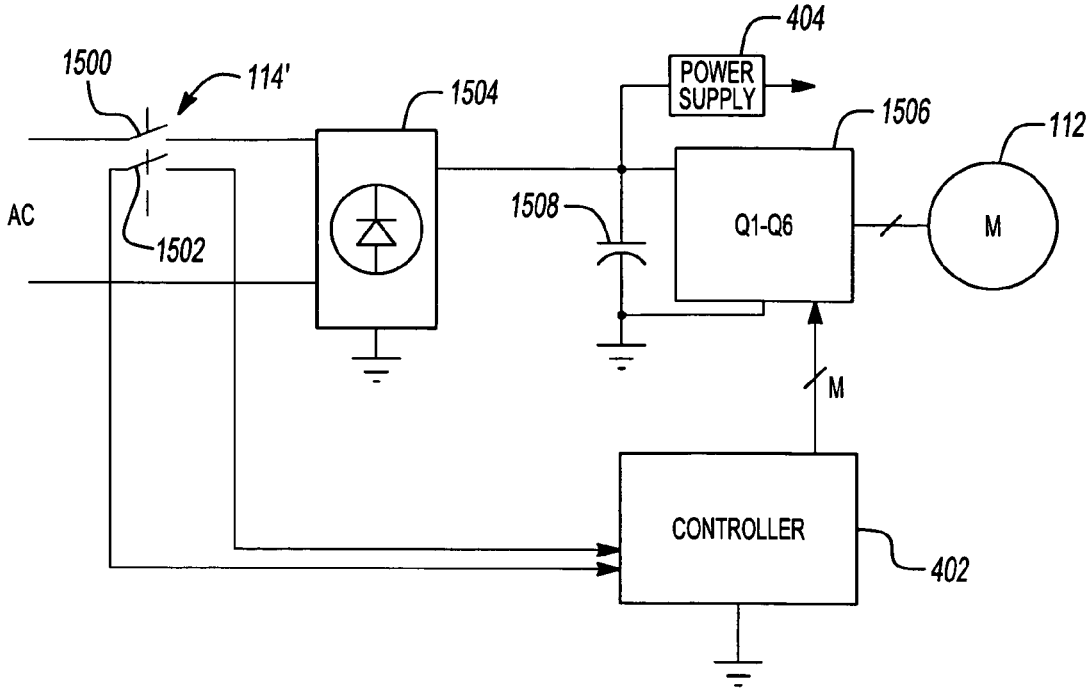
FIG. 15 is a simplified schematic of a variation of the control system of FIG. 4.
Figure 16:
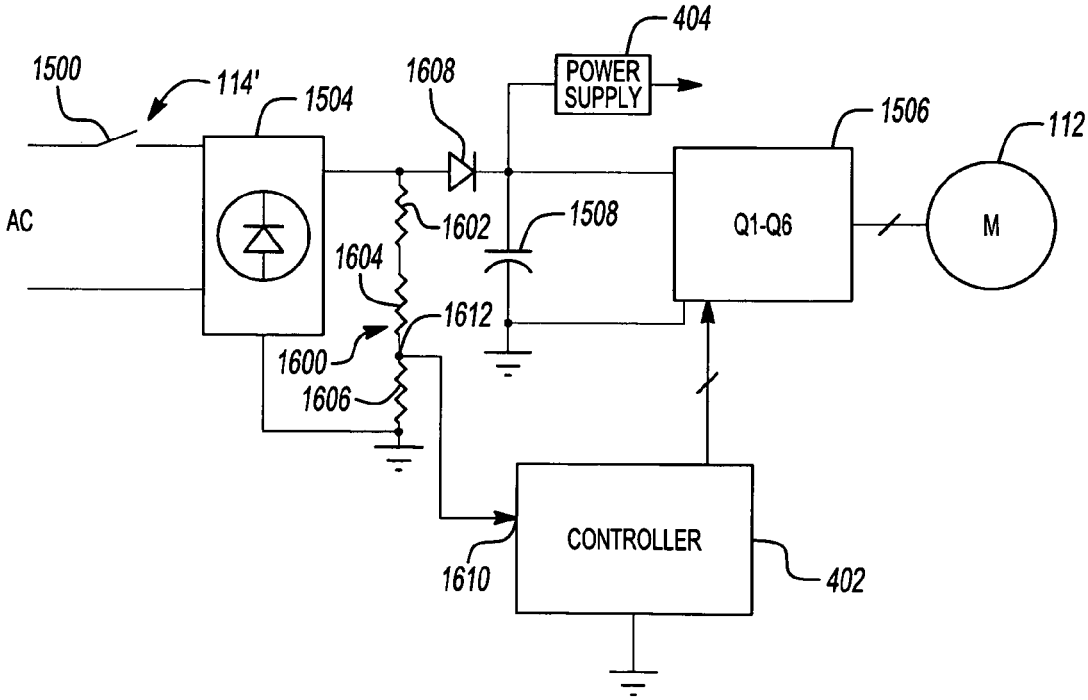
FIG. 16 is a simplified schematic of a variation of the control system of FIG. 15.

FIGS. 15 and 16 show variations 400' (FIG. 15) and 400" (FIG. 16) of control system 400 in which on/off switch 114 (FIG. 1) is a "mains" switch—a switch that switches mains power. In the variation of FIG. 15, on/off switch 114' includes a power contact 1500 and a brake contact 1502. One side of power contact 1500 is coupled to one line of an AC source and the other side of power contact 1500 is coupled to rectifier 1504. An output of rectifier 1504 is coupled to inverter circuit 1506, which includes Q1-Q6 as shown in FIG. 4, which in turn is coupled to windings of motor 112. A capacitor 1508 is coupled across the output of rectifier 1504 to common. Brake contact 1502 of on/off switch 114' is coupled across inputs of controller 402.

In operation of electronic motor commutation system 400', when on/off switch 114' is closed, AC power is coupled to rectifier 1504 through power contact 1500. Brake contact 1502 is also closed. Capacitor 1508 is charged. When on/off switch 114' is opened, power contact 1500 and brake contact 1502 are opened. Opening main power contact 1500 disconnects AC power from rectifier 1504. Controller 402 senses the opening of brake contact 1502 and initiates braking. Capacitor 1508 supplies power to power supply 404 and inverter circuit 1506, allowing controller 402 to control inverter circuit 1506 to reverse commutate motor 112 to electrically brake motor 112. Dynamic braking may illustratively continue until capacitor 1508 is discharged to the point that it can no longer provide adequate power to operate controller 402 and inverter circuit 1506.

In the variation of FIG. 16, on/off switch 114" has only power contact 1500 and not brake contact 1502. A voltage divider network 1600, illustratively including resistors 1602, 1604, 1606, is coupled across the output of rectifier 1504 and common. A diode 1608 is coupled between the output of rectifier 1504 and power supply 404, inverter circuit 1506 and power supply 404 to separate them from the voltage divider network 1600. An input, referred to herein as brake input 1610, of controller 402 is coupled to a node 1612 of voltage divider network 1600.

In operation of control system 400", before power cord 118 of sander 100 that includes control system 400" is plugged into a source of AC for the first time and on/off switch 114" turned on, capacitor 1508 is completely discharged. In an initial start up, when on/off switch 114" is first turned on after sander 100 is first plugged in to a source of AC, diode 1608 is forward biased and brake input 1610 of controller 402 is at a logic high. Capacitor 1508 is charged. When on/off switch 114" is turned off, AC power is disconnected to rectifier 1504. Capacitor 1508 is still charged and diode 1608 is reversed biased. Node 1612 of voltage divider network 1600 is pulled low through resistor 1606, bringing brake input 1610 of controller 402 to a logic low. In response to the logic low on brake input 1610, controller 402 initiates braking and switches inverter circuit 1506 to reverse commutate motor 112 to do so. Capacitor 1508 provides power to inverter circuit 1506 and controller 402. Controller 402 may illustratively continue braking motor 112 until capacitor 1508 is discharged to the point where it can no longer power inverter circuit 1506 and controller 402.

As long as capacitor 1508 is sufficiently charged to power controller 402, a user can turn on/off switch 114" on and controller 402 will detect this through brake input returning to a logic high. Controller 402 will then run motor 112 as described above. If capacitor 1508 has discharged to the point where it is no longer powering controller 402 when the user turns on/off switch 114" back on, control system 400" will start up as described above for the initial start up.

In another illustrative embodiment, sander 100 includes both dynamic and mechanical braking. That is, sander 100 includes brake member 48 and ring 61, as discussed above, as well as having controller 402 configured to electronically brake motor 112. By supplementing mechanical braking with dynamic braking, applicants have found that the braking time, the time that it takes to slow orbit mechanism 104 to a desired speed, which can include slowing motor 112 to idle speed as discussed above or braking orbit mechanism 104 to a complete stop, can be reduced to two seconds or less. In this regard, when motor 112 is braked to idle speed, the mechanical brake may illustratively remain engaged and motor 112 is driven to overcome the braking force exerted by the mechanical brake and run at the idle speed.

Mechanical braking can be combined with dynamic braking in orbital sanders that use motors other than electronically commutated motors. For example, mechanical braking can be combined in a sander that uses a permanent magnet DC motor, that is, a motor having a wound armature and a stator with permanent magnets, where the DC may be provided by rectified AC or by a battery. It can also be used in orbital sanders having universal motors. In each instance, the orbital sander may illustratively use a known dynamic braking, such as, for example, the dynamic braking for permanent magnet PM motors as described in U.S. Ser. No. 10/972,964 for Method and Device for Braking a Motor filed Oct. 22, 2004, and the dynamic braking for universal motors as described in U.S. Pat. No. 5,063,319 "Universal Motor with Secondary Winding Wound with the Run Field Winding" issued Nov. 5, 1991. The entire disclosures of U.S. Ser. No. 10/972,964 and U.S. Pat. No. 5,063,319 are incorporated by reference herein.

Figure 13:
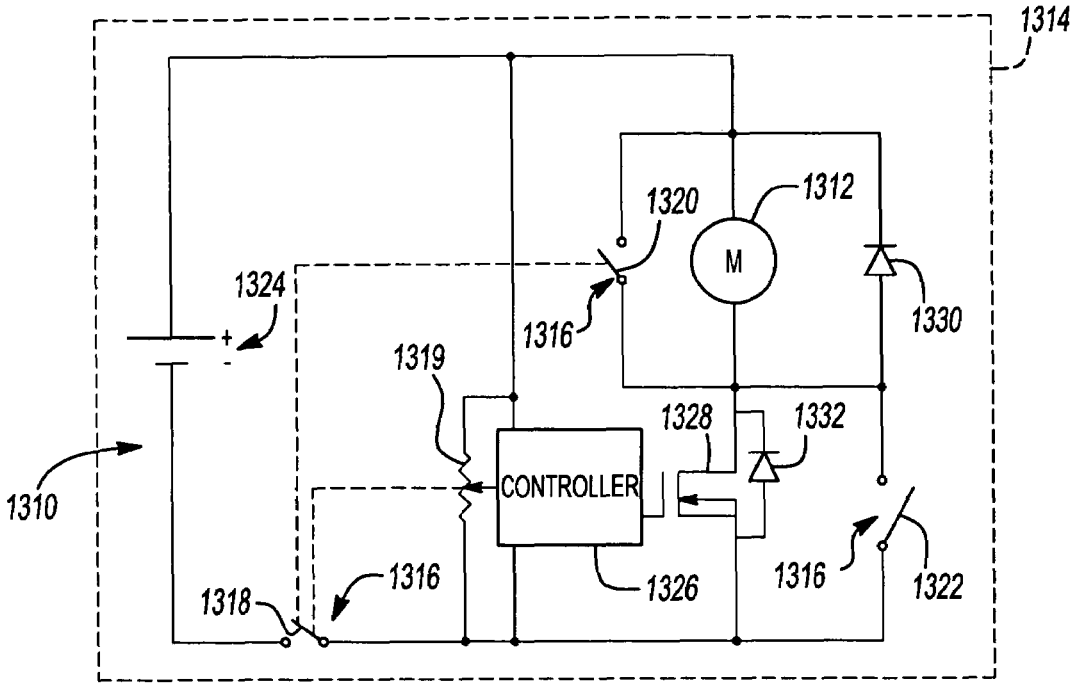
Fig-13 PRIOR ART
FIG. 13 is a simplified circuit schematic of a prior art motor control having dynamic braking for a permanent magnet DC motor.

For convenience of reference, FIG. 1 of U.S. Ser. No. 10/972,964 is reproduced here as FIG. 13 and FIG. 3 of U.S. Pat. No. 5,063,319 is reproduced as FIG. 14. The discussion of them and dynamic braking in U.S. Ser. No. 10/972,964 and U.S. Pat. No. 5,063,319 follow. With reference first to FIG. 13, prior art motor control circuit 1310 for controlling power to a permanent magnet DC motor 1312 in a power tool electrical system 1314 (shown representatively by dashed box 1314) where power tool electrical system 1314 is illustratively a variable speed system, such as would be used in a variable speed drill or used in an orbital sander 100 having variable speed. Motor control circuit 1310 includes a power switch 1316, illustratively a trigger switch (which in the case of an orbital sander, could be a paddle switch having a potentiometer as discussed above), having main power contacts 1318, braking contacts 1320 and bypass contacts 1322. Main power contacts 1318 and braking contacts 1320 are linked so that they operate in conjunction with each other. Main power contacts 1318 are normally open and braking contacts 1320 are normally closed and both are break-before-make contacts. The normally open side of main power contacts 1318 is connected to the negative terminal of a battery 1324 and the common side of main power contacts 1318 is connected to controller 1326 of motor control circuit 1310. Motor control circuit 1310 also includes run power switching device 1328 and free wheeling diode 1330.

Run power switching device 1328 is illustratively a N-channel MOSFET with its gate connected to an output of controller 1326, its source connected to the common side of main power contacts 1318 and its drain connected the common side of braking contacts 1320 of trigger switch 1316, to one side of the windings of motor 1312 and to the anode of diode 1330. As is known, MOSFETs have diodes bridging their sources and drains, identified as diode 1332 in FIG. 1. The other side of braking contacts 1320 is connected to the positive side of a DC source 24 (which as discussed can be a battery or rectified AC) as is the other side of the windings of motor 1312 and the cathode of diode 1330. Since motor 1312 is illustratively a wound armature/permanent magnet field motor, the motor windings to which the drain of run power switching device 1328 and the positive side of the DC source 24 are connected are the armature windings.

Controller 1326 is illustratively a pulse width modulator that provides a pulse width modulated signal to the gate of run power switching device 1328 having a set frequency and a variable duty cycle controlled by a variable resistance. The variable resistance is illustratively a potentiometer 1319 mechanically coupled to trigger switch 1316. In this regard, controller 1326 can be a LM 555 and potentiometer, the LM 555 configured as a pulse width modulator having a set frequency and a variable duty cycle controlled by the potentiometer that is mechanically coupled to trigger switch 1316.

In operation, trigger switch 1316 is partially depressed, opening braking contacts 1320 and closing, a split second later, main power contacts 1318. This couples power from battery 1324 to controller 1326, to the source of run power switching device 1328 and to bypass contacts 1322 (that remain open at this point). Controller 1326 generates a pulse width modulated signal at the gate of run power switching device 1328, cycling it on and off. Run power switching device 1328 switches power on and off to the windings of motor 1312 as it cycles on and off. The duty cycle of the pulse width modulated signal, that is, how long it is high compared to how long it is low, provided at the gate of run power switching device 1328 is determined by how far trigger switch 1316 is depressed. (How far trigger switch 1316 is depressed determines the variable resistance of the potentiometer 19 mechanically coupled to it that provides the variable resistance used to set the duty cycle of controller 1326.) The duty cycle of the pulse width modulated signal determines the speed of motor 1312. As trigger switch 1316 is depressed further, bypass contacts 1322 close, typically when trigger switch 1316 is depressed to about the eighty percent level. When bypass contacts 1322 close, power is connected directly from the DC source 24 to the motor windings and the variable speed control provided by controller 1326 and run power switching device 1328 is bypassed. Motor 1312 then runs at full speed.

Diode 1330, known as a free wheeling diode, provides a path for the current in the windings of motor 1312 when run power switching device 1328 switches from on to off. Current then flows out of the motor windings at the bottom of motor 1312 (as oriented in FIG. 1) through diode 1330 and back into the motor windings at the top of motor 1312 (as oriented in FIG. 13).

When trigger switch 1316 is released to stop motor 1312, main power contacts 1318 of trigger switch 1316 open with braking contacts 1320 closing a split second later. (Bypass contacts 1322, if they had been closed, open as trigger switch 1316 is being released.) Closing braking contacts 1320 shorts the motor windings of motor 1312, braking motor 1312. In a variation, a resistor is connected in series with braking contacts 1320 so that the resistor is coupled across the windings of motor 1312 to brake motor 1312.

Where the power tool is not a variable speed tool, such as a saw or an orbital sander that does not have variable speed, controller 1326, run power switching device 1328, bypass contacts 1322 and diode 1330 are eliminated. Braking contacts 1320 operate in the same manner described above to brake motor 1312.

Figure 14:
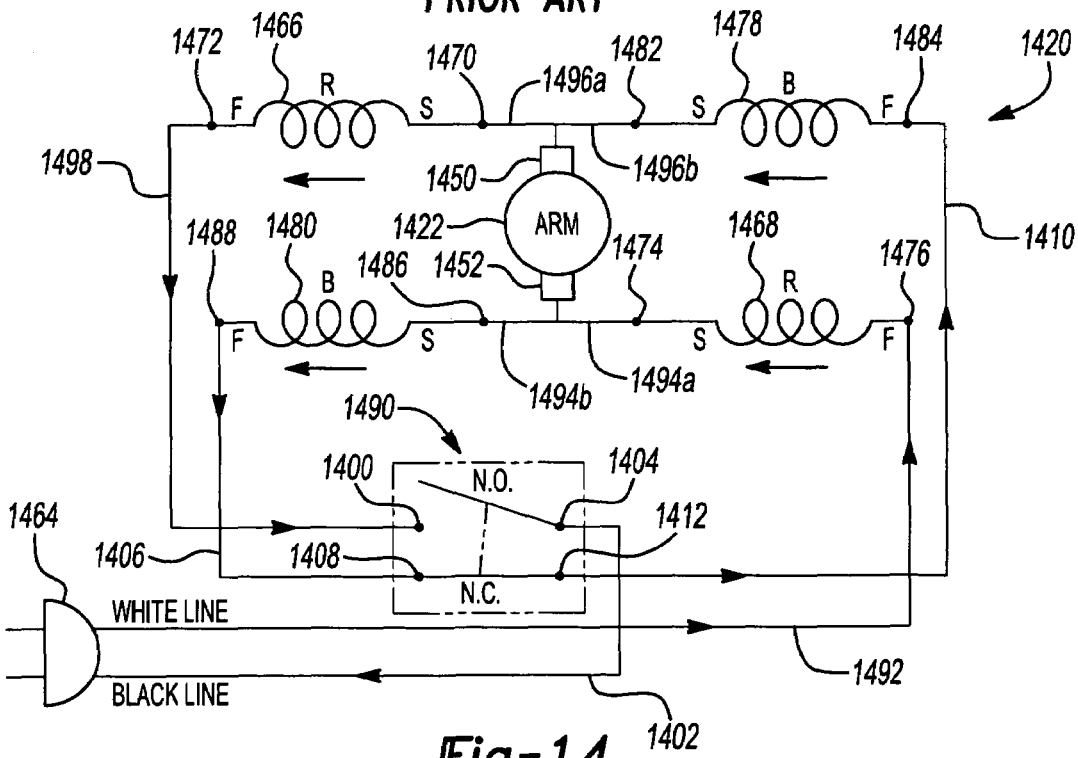
Fig-14 PRIOR ART
FIG. 14 is a simplified schematic of a prior art motor control having dynamic braking of a universal motor.

With reference to FIG. 14, motor 1420 is of the series wound-type, often called a universal motor. Run field windings designated generally by the letter R in the drawings are connectable in series with armature 1422 and a conventional source of electrical power 1464. In this embodiment the run winding is split into two portions connected electrically on opposite sides of the armature 1422 and comprising first and second run windings 1466, 1468, respectively, and connected respectively to first and second sides of the armature 1422 represented by brushes 1450, 1452. Each run winding has first and second ends or terminations respectively: 1470, 1472 for the first run winding 1466; and 1474, 1476 for the second run winding 1468.

The motor 1420 also includes a secondary field winding, in this embodiment provided specifically for a dynamic braking function and designated generally by the letter B. The brake winding B is connectable in shunt across the armature 1422. In an arrangement similar to that of the run windings, the brake winding consists of first and second brake field windings 1478, 1480 connected respectively to the first and second sides of the armature 1422 as represented by brushes 1450, 1452. Each brake field winding 1478, 1480 has first and second ends or terminations 1482, 1484 and 1486, 1488, respectively.

Switching between a run mode and braking mode for the motor 1420 may be accomplished by a suitable switching arrangement such as that provided by the switch 1490. Functionally this consists of two single pole, single throw switches with alternate contact (one pole normally open, one pole normally closed). Motor connections are completed (schematically) by suitable conductors as follows: 1492 from the power supply 1464 to second run winding second termination 1476; 1494*a* and 1494*b* respectively from second run and second brake winding first terminations 1474, 1486, respectively to the armature 1422, second side 1452; 1496*a* and 1496*b* from the armature first side 1450 respectively to first run and first brake winding first terminations 1470 and 1482; 1498 from the first run winding second termination 1472 to switch contact 1400; 1402 from switch terminal 1404 to power supply 1464; 1406 from switch contact 1408 to second brake winding second termination 88; and 1410 from first brake winding second termination 1484 to switch terminal 1412.

In another illustrative embodiment, only dynamic braking is used in sander 100 and controller 402 is configured to switch the appropriate semiconductors Q1-Q6, such as semiconductors Q4-Q6, to brake motor 112 to brake orbit mechanism 104 to a desired speed in two seconds or less.

In an illustrative embodiment, on/off switch 114 is not a mains on/off switch, but provides an on/off logic signal to controller 402 and controller 402 turns motor 112 and off in response to that logic signal. Since switch 114 is not a mains on/off switch, controller 402 may illustratively be configured to provide a no-volt release function. A no-volt release function senses whether the trigger switch is depressed or pulled when the tool is first powered on and if it is, does not allow the motor to start until the trigger switch has been cycled (released and then depressed). No-volt release functions are described in greater detail in U.S. Ser. No. 10/360,957 filed Feb. 7, 2003 for Method for Sensing Switch Closure to Prevent Inadvertent Startup and U.S. Ser. No. 10/696,449 filed Oct. 29, 2003 for Method and System for Sensing Switch Position to Prevent Inadvertent Startup of a Motor (which are incorporated herein in their entireties by reference). Sander 100 may also have a reversing switch 412 that provides a logic level signal to controller 402. Based on this logic level signal, controller 402 provides forward or reverse commutation to motor 112 to run it in the forward direction or the reverse direction.

Figure 11:
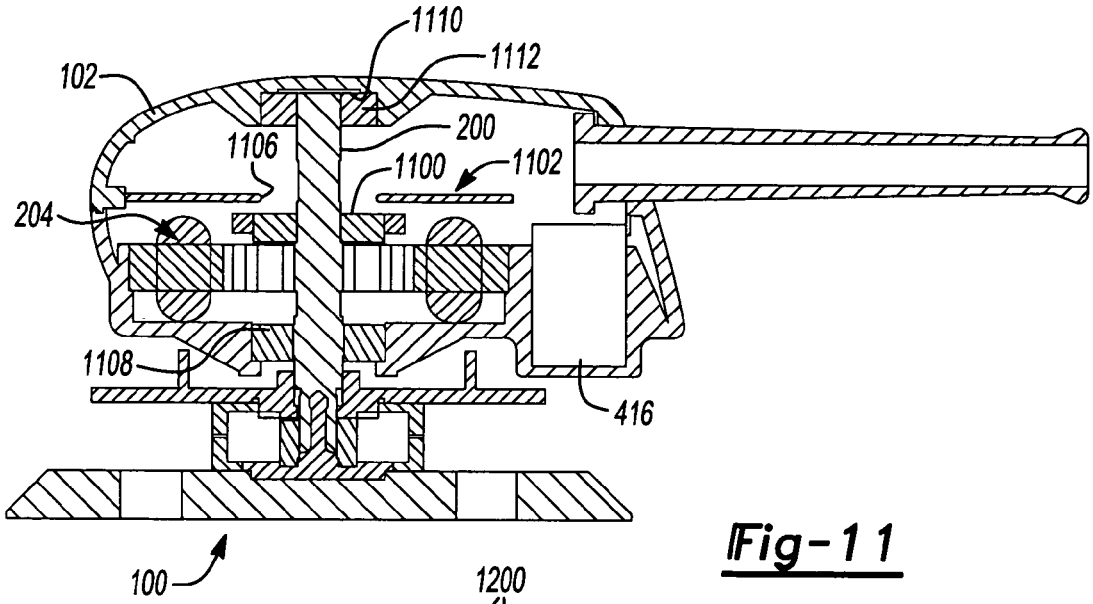
FIG. 11 is a side cross-section of the sander of FIG. 1.

In order to achieve the low profile nature of sander 100, it is important not only that motor 112 have the appropriate aspect ratio as discussed above, but also to minimize the effect that other components have on the height of sander 100. In this regard, with reference to FIG. 11, the windings 204 are wound to minimize the height of the end turns of windings 204. A position sense magnet 1100 affixed to rotor 200 sensed by sensors 308 (FIG. 3) may illustratively be axial in orientation and made axially thin. Sensors 308 are mounted on a side of a printed circuit board 1102 that faces position sense magnet 1100 and the printed circuit board 1102 illustratively located within 2.5 mm of the surface of position sense magnet 1100. This permits sensor 308 when they are Hall Effect sensors to be properly activated by position sense magnet 1100. To the extent possible, printed circuit board 1102 is propagated with surface mount components to minimize the height of printed circuit board 1102. Filter or smoothing capacitor 416, which filters or smoothes the output of rectifier 418, is mounted within housing 102 in an orientation so that it does not increase the height above printed circuit board 1102.

Printed circuit board 1102 includes a central hole 1106 sized to permit a drive end bearing 1108 to be passed through it during assembly. Rotor 200 may thus be subassembled by first placing drive end bearing 1108 on it and rotor 200 then "dropped into" housing 102 in which printed circuit board 1102 has previously been placed during assembly of sander 100.

Housing 102 includes a bearing pocket 1110 in which an opposite drive end bearing 1112 is received. Printed circuit board 1102 may illustratively be disposed in housing 102 between opposite drive end bearing 1112 and windings 204. In this event, printed circuit board 1102 is disposed where the commutator and brushes in a brush motor, such as a universal motor, are typically disposed.

Cord 118 is brought in through an end cap of housing 102 and the wires in cord 118 connected to printed circuit board 1102. Leads of windings 204 are brought up and connected to printed circuit board 1102.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A low profile, hand held orbital electric sander, comprising:

a. a housing and an orbit mechanism disposed beneath the housing;

b. a motor disposed within the housing, the motor having a stator, the stator having a lamination stack having a height, the motor having a diameter and an overall height wherein a motor diameter to stator lamination height ratio is at least 2:1 and a motor diameter to overall motor height ratio is at least 1:1; and c. the housing including a palm grip having a diameter and the sander is a corded sander having a maximum height of 120 mm and the palm grip diameter to sander height ratio is at least 0.6:1.

2. The apparatus of claim 1 wherein the palm grip has a diameter in a range of 30 mm to 90 mm.

3. The apparatus of claim 1 wherein the palm grip has a diameter in a range of 70 mm to 90 mm.

4. The apparatus of claim 1 wherein the sander is a corded sander having a maximum height of 100 mm, the palm grip has a maximum diameter of 90 mm, the motor has a diameter to stack height ratio of at least 7.5:1 and a rated power output of at least 120 watts.

5. The apparatus of claim 1 wherein the sander is a corded sander having a maximum height of 95 mm, the palm grip has a maximum diameter of 90 mm, the motor has a diameter to stack height ratio of at least 7.5:1 and a rated power output of at least 120 watts.

6. The apparatus of claim 5 wherein the motor has a rated power output of at least 200 watts.

7. The apparatus of claim 1 wherein the sander is a corded sander having a maximum height of 90 mm, the palm grip has a maximum diameter of 90 mm, the motor has a diameter to stack height ratio of at least 7.5:1 and a rated power output of at least 120 watts.

8. The apparatus of claim 1 wherein the palm grip diameter to sander height ratio is at least 1:1.

9. The apparatus of claim 1 wherein the motor is an electronically commutated motor.

10. The apparatus of claim 9 wherein the electronically commutated motor is an AC synchronous motor.

11. The apparatus of claim 9 wherein the electronically commutated motor is a brushless DC motor.

12. The apparatus of claim 9 wherein the motor diameter to stator lamination height ratio is greater than 5:1.

13. The apparatus of claim 9 including a five inch platen wherein the motor has a rated power output of at least 70 watts.

14. The apparatus of claim 9 including a five inch platen, the motor having a rated power output of at least 100 watts and a motor diameter to lamination height ratio of at least 3:1.

15. The apparatus of claim 9 including a six inch platen wherein the motor has a rated power of at least 100 watts.

16. The apparatus of claim 9 including a six inch platen, the motor having a rated power of at least 120 watts and a motor diameter to lamination height ratio of at least 3:1.

17. The apparatus of claim 16 wherein the motor has a rated power output of at least 200 watts.

18. The apparatus of claim 9 including a motor controller that electronically commutates the motor by switching switches that switch power to the motor in an electronic commutation sequence, the sander including a mechanical brake that brakes the orbit mechanism and the motor controller switching the switches to electronically brake the motor.

19. The apparatus of claim 18 wherein the mechanical brake mechanically braking the orbit mechanism and the motor controller electronically braking the motor brakes the orbit mechanism to a desired speed in no greater than about two seconds.

20. The apparatus of claim 19 wherein the desired speed is stop.

21. The apparatus of claim 19 wherein the desired speed is an idle speed.

22. The apparatus of claim 18 including a resistor that is coupled across windings of the motor when the motor controller electronically brakes the motor.

23. The apparatus of claim 9 including an on/off switch and a motor controller that electronically commutates the motor by switching switches that switch power to the motor in an electronic commutation sequence, the motor controller sensing collapse of an input voltage when the on/off switch is turned off and switching the switches to electronically brake the motor.

24. The apparatus of claim 23 including a resistor that is coupled across windings of the motor when the motor controller electronically brakes the motor.

25. The apparatus of claim 23 wherein the on/off switch is a mains switch having a power contact but not a brake contact, one side of the power contact coupled to an input of the motor controller to provide the input voltage and another side of the power contact coupled to a source of mains power.

26. The apparatus of claim 25 wherein the side of the power contact coupled to the input of the motor controller is coupled to the motor controller through at least one electronic component.

27. A low profile, hand held orbital electric sander, comprising:

a. a housing and an orbit mechanism disposed beneath the housing;

b. a motor having a rated power output of at least 40 watts disposed within the housing, the motor having a stator, the stator having a lamination stack having a height, the motor having a diameter and an overall height wherein a motor diameter to stator lamination height ratio is at least 2:1 and a motor diameter to overall motor height ratio is at least 1:1; and c. the housing including a palm grip having a diameter and the sander having a height wherein a palm grip diameter to sander height ratio is at least 0.4:1.

28. A low profile, hand held orbital electric sander, comprising:

a. a housing and an orbit mechanism disposed beneath the housing;

b. an electronically commutated motor disposed within the housing, the motor having a stator, the stator having a lamination stack having a height, the motor having a diameter and an overall height wherein a motor diameter to stator lamination height ratio is at least 2:1 and a motor diameter to overall motor height ratio is at least 1:1;

c. a power cord coupled to the motor for connecting the motor to a source of AC; and d. the housing including a palm grip having a diameter and the sander having a height wherein a palm grip diameter to sander height ratio is at least 0.6:1.

29. The apparatus of claim 28 wherein the sander has a maximum height of 120 mm.

30. The apparatus of claim 29 wherein the electronically commutated motor is an AC synchronous motor.

31. The apparatus of claim 29 wherein the electronically commutated motor is a brushless DC synchronous motor.

32. The apparatus of claim 29 wherein the palm grip diameter to sander height ratio is at least 1:1.

33. The apparatus of claim 29 wherein the motor diameter to stator lamination height ratio is greater than 5:1.

34. The apparatus of claim 29 including a five inch platen and the motor having a rated power output of at least 70 watts.

35. The apparatus of claim 29 including a five inch platen, the motor having a rated power output of at least 100 watts and a motor diameter to lamination height ratio of at least 3:1.

36. The apparatus of claim 35 wherein the sander is a random orbital sander.

37. The apparatus of claim 35 wherein the sander is a pad sander.

38. The apparatus of claim 29 including a six inch platen, the motor having a rated power of at least 100 watts.

39. The apparatus of claim 29 including a six inch platen, the motor having a rated power of at least 120 watts and a motor diameter to lamination height ratio of at least 3:1.

40. The apparatus of claim 39 wherein the motor has a rated power output of at least 200 watts.

41. The apparatus of claim 39 wherein the sander is a random orbital sander.

42. The apparatus of claim 39 wherein the sander is a pad sander.

43. The apparatus of claim 28 wherein the motor has a rated power output of at least 40 watts.

44. The apparatus of claim 28 including a motor controller that electronically commutates the motor by switching switches that switch power to the motor in an electronic commutation sequence, the sander including a mechanical brake that brakes the orbit mechanism and the motor controller switching the switches to electronically brake the motor.

45. The apparatus of claim 44 wherein the mechanical brake mechanically braking the orbit mechanism and the motor controller electronically braking the motor brakes the orbit mechanism to a desired speed in no greater than about two seconds.

46. The apparatus of claim 45 wherein the desired speed is stop.

47. The apparatus of claim 45 wherein the desired speed is an idle speed.

48. The apparatus of claim 28 including an on/off switch and a motor controller that electronically commutates the motor by switching switches that switch power to the motor in an electronic commutation sequence, the motor controller sensing collapse of an input voltage when the on/off switch is turned off and switching the switches to reverse commutate the motor to electronically brake the motor.

49. The apparatus of claim 48 wherein the on/off switch is a mains switch having a power contact but not a brake contact, one side of the power contact coupled to an input of the motor controller to provide the input voltage and another side of the power contact coupled to a source of mains power.

50. The apparatus of claim 49 wherein the side of the power contact coupled to the input of the motor controller is coupled to the motor controller through at least one electronic component.

51. A low profile, hand held orbital electric sander, comprising:

a. a housing and an orbit mechanism disposed beneath the housing;

b. a motor disposed within the housing, the motor having a stator, the stator having a lamination stack having a height, the motor having a diameter and an overall motor height wherein a motor diameter to stator lamination height ratio is at least 2:1 and a motor diameter to overall motor height ratio is at least 1:1;

c. the housing including a palm grip having a diameter and the sander having a height wherein a palm grip diameter to sander height ratio is at least 0.4:1; and d. a switch coupled across windings of the motor that dynamically brakes the motor and a mechanical brake that brakes the orbit mechanism.

52. The apparatus of claim 51 wherein the combined dynamic and mechanical braking brakes the orbit mechanism to a desired speed in no more than about two seconds.

53. The apparatus of claim 52 wherein the desired speed is stop.

54. The apparatus of claim 52 wherein the desired speed is an idle speed.

55. The apparatus of claim 51 including a resistor that is coupled across windings of the motor by the switch in dynamically braking the motor.

56. The apparatus of claim 51 wherein the switch shorts the motor windings to dynamically brake the motor.

* * * * *